US008879966B2

(12) United States Patent
Tanaka et al.

(10) Patent No.: US 8,879,966 B2
(45) Date of Patent: Nov. 4, 2014

(54) DEVELOPING DEVICE AND IMAGE FORMING APPARATUS USING THE SAME

(71) Applicant: Fuji Xerox Co., Ltd., Tokyo (JP)

(72) Inventors: Yoshinori Tanaka, Kanagawa (JP); Keisuke Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 13/683,107

(22) Filed: Nov. 21, 2012

(65) Prior Publication Data

US 2013/0195515 A1 Aug. 1, 2013

(30) Foreign Application Priority Data

Jan. 26, 2012 (JP) ..... 2012-014023

(51) Int. Cl.
*G03G 15/09* (2006.01)
*G03G 15/08* (2006.01)

(52) U.S. Cl.
CPC ..... *G03G 15/0865* (2013.01); *G03G 15/0896* (2013.01); *G03G 15/0921* (2013.01); *G03G 2215/0648* (2013.01)
USPC ..... 399/269; 399/275

(58) Field of Classification Search
USPC ..... 399/269, 275, 277
See application file for complete search history.

(56) References Cited

U.S. PATENT DOCUMENTS 5,987,288 A 11/1999 Mori et al.
2011/0229214 A1* 9/2011 Oba et al. ..... 399/269
2011/0229215 A1* 9/2011 Hirota et al. ..... 399/269

FOREIGN PATENT DOCUMENTS

JP 11-161032 A 6/1999

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

A developing device includes a first developing unit, a second developing unit, a rotating member, a magnetic pole forming member, a first separating pole, a second separating pole, a developer supplying unit, and a path formation member. The developing device is provided with a magnetic structure, in which, when a value of a magnetic flux density at which the developer is separated is a reference separation value, at a side of the first separating pole at the separation area of the second developing unit, a position where a magnetic flux density of a vertical component of a magnetic force becomes less than or equal to the reference separation value is disposed downstream in the direction of rotation of the rotating member of a position where a magnetic flux density of a horizontal component of the magnetic force becomes less than or equal to the reference separation value.

5 Claims, 7 Drawing Sheets

DEVELOPING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2012-014023 filed Jan. 26, 2012.

BACKGROUND (i) Technical Field

The present invention relates to a developing device and an image forming apparatus using the same.

(ii) Related Art

In an image forming apparatus, such as a copying machine or a printer, an electrostatic latent image formed on a surface of a photoconductor drum is developed into a toner image by causing toner supplied from a developing device, which is set so as to oppose the surface of the photoconductor drum, to adhere to the electrostatic latent image.

In such a developing device that performs development, since toner density is reduced due to consumption of the toner by the development, if any developer remaining on a developing roller without being used for the development is repeatedly transported as it is to a development area, it is not possible to perform proper development, as a result of which image failure occurs. Therefore, it is necessary to separate the developer remaining on the developing roller from the developing roller and return the separated developer to a developer supply mechanism that is set in the developing device.

In order to achieve a high-speed image forming apparatus, a double developing device including double developing rollers for reliably performing development is available as a developing device. In the double developing device, any residual developer remaining on the lower developing roller without being used in the development is collected by a developer supply mechanism as a result of being separated from the lower developing roller when magnetic restraining force is lost at a separating pole. Even if the residual developer remains on the surface of the developing roller because the developer is not completely separated, a large amount of developer prior to the regulation of a layer and newly supplied from the developer supply mechanism is mixed with the residual developer. Therefore, the influence on a reduction in toner density at the lower developing roller is relatively small.

SUMMARY

According to an aspect of the invention, there is provided a developing device including a first developing unit that performs development to form a toner image using developer; a second developing unit that is disposed above the first developing unit and that performs development to form the toner image using the developer; a rotating member that is rotatably provided at an outer periphery of the second developing unit; a magnetic pole forming member that is provided at an inner side of the rotating member, the magnetic pole forming member having separating poles that include a first separating pole and a second separating pole, the separating poles defining a separation area where the developer is separated; the first separating pole that defines a starting point of the separation area; the second separating pole that is disposed downstream of the first separating pole in a direction of rotation of the rotating member, the second separating pole defining an end point of the separation area; a developer supplying unit that supplies the developer to the first developing unit and the second developing unit; and a path formation member that is disposed with an end portion thereof being out of contact with the outer periphery of the second developing unit, the path formation member forming a path for returning residual developer remaining on the second developing unit without being used in the development to the developer supplying unit. The developing device is provided with a magnetic structure, in which, when a value of a magnetic flux density at which the developer is separated is a reference separation value, at a side of the first separating pole at the separation area of the second developing unit, a position where a magnetic flux density of a vertical component of a magnetic force becomes less than or equal to the reference separation value is disposed downstream in the direction of rotation of the rotating member of a position where a magnetic flux density of a horizontal component of the magnetic force becomes less than or equal to the reference separation value.

BRIEF DESCRIPTION OF THE DRAWINGS

An exemplary embodiment of the present invention will be described in detail based on the following figures, wherein.

DETAILED DESCRIPTION

Figure 1:
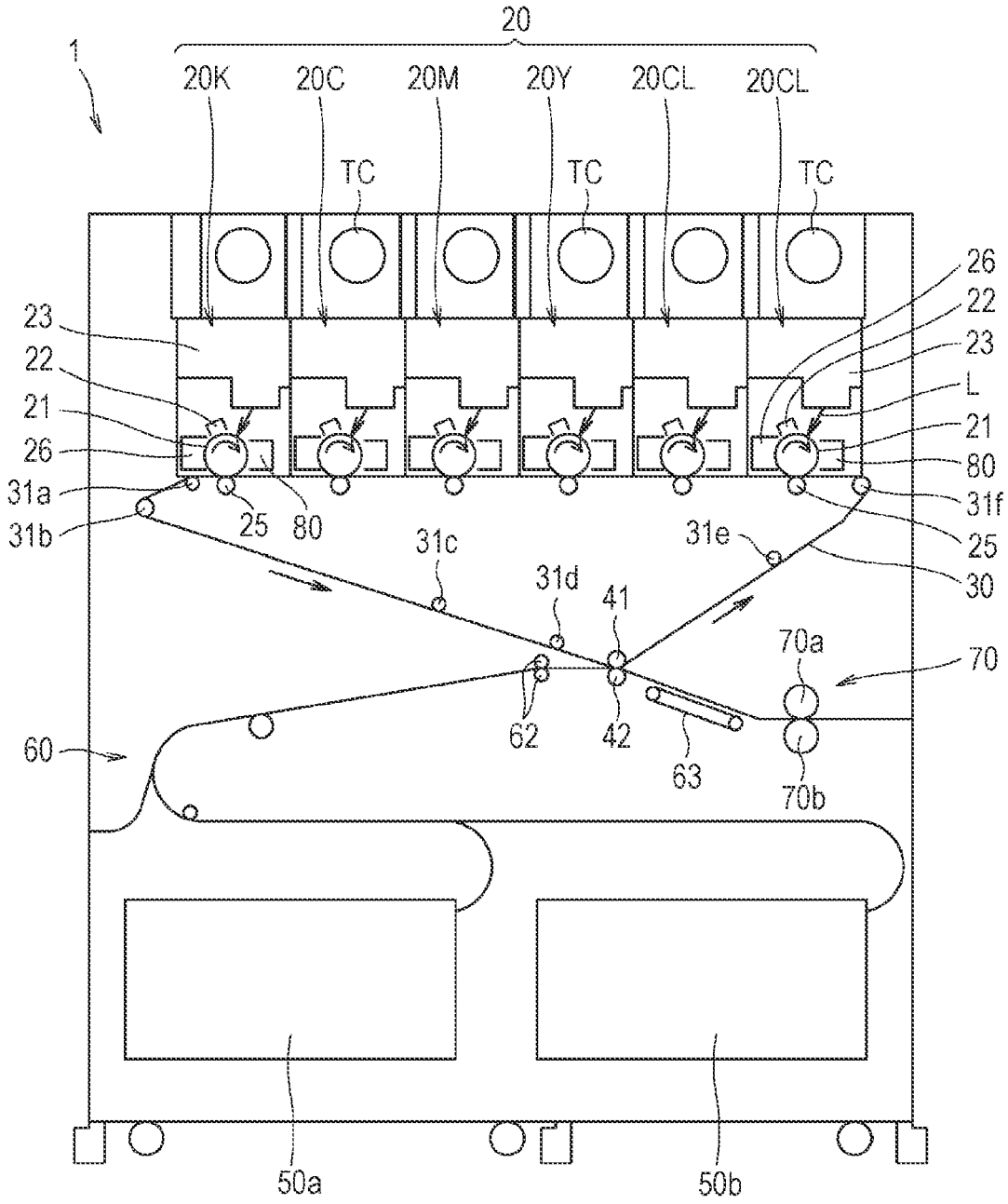
FIG. 1 is a conceptual view of an exemplary image forming apparatus according to an exemplary embodiment of the present invention.

An exemplary embodiment of the present invention will hereunder be described in detail with reference to the drawings. In the drawings for illustrating the exemplary embodiment, corresponding components are generally given the same reference numerals, and the same descriptions will not be repeated below.

FIG. 1 is a conceptual view of an exemplary image forming apparatus 1 according to an exemplary embodiment of the present invention.

The image forming apparatus 1 according to the exemplary embodiment is, for example, a tandem color printer, and includes image forming units 20, an intermediate transfer belt (an exemplary transfer member) 30, a backup roller 41 and a first transfer roller 42 that form a pair, sheet supply trays 50*a* and 50*b*, a sheet transporting system 60, and a fixing device 70.

The image forming units 20 correspond to four color image forming units 20Y, 20M, 20C, and 20K (for forming toner images of corresponding colors, such as yellow, magenta, cyan, and black), and, for example, clear-color image forming units 20CL and 20CL that transfer toner images of clear colors. The toner images formed in accordance with pieces of image information of the corresponding colors are first-transferred to the intermediate transfer belt 30.

These six image forming units, that is, the image forming unit 20CL, the image forming unit 20CL, the image forming unit 20Y, the image forming unit 20M, the image forming unit 20C, and the image forming unit 20K are disposed in accordance with the corresponding colors, the clear color, the clear color, yellow, magenta, cyan, and black, in that order along the direction of rotation of the intermediate transfer belt 30. Instead of the image forming units for clear colors, for example, an image forming unit for a light color, such as light yellow, light magenta, light cyan, or light black, that transfers a toner image of a light color may be provided. Alternatively, an image forming unit 20CL for a clear color and an image forming unit for a light color may both be disposed side by side.

Each image forming unit 20 includes a photoconductor drum (an exemplary image carrying member) 21, a charging device 22, an exposing device 23, a developing device 80, a first transfer roller (an exemplary transferring unit) 25, and a drum cleaner 26. Each charging device 22 charges the surface of its corresponding photoconductor drum 21 to a prescribed potential. Each exposing device 23 irradiates the corresponding charged photoconductor drum 21 with laser light L to form an electrostatic latent image. Each developing device 80 develops the electrostatic latent image formed on the corresponding photoconductor drum 21 by the corresponding exposing device 23 to form a toner image. Each first transfer roller 25 transfers the toner image carried by its corresponding photoconductor drum 21 to the intermediate transfer belt 30 at a first transfer section. Each drum cleaner 26 removes, for example, residual toner or paper powder from the surface of its corresponding photoconductor drum 21 after the transfer of the toner image. Toner cartridges TC that supply developer to the developing devices 80 are set at upper sides of the image forming units 20.

The first transfer rollers 25 of the respective image forming units 20 are disposed so that the first transfer rollers 25 and the corresponding photoconductor drums 21 nip the intermediate transfer belt 30. By applying a transfer bias voltage having a polarity that is opposite to a charging polarity of toner to each first transfer roller 25, electric fields are formed between the photoconductor drums 21 and the first transfer rollers 25. Therefore, the toner images that are charged on the photoconductor drums 21 are transferred to the intermediate transfer belt 30 by coulomb forces. The photoconductor drums 21 rotate clockwise during first transfer.

The intermediate transfer belt 30 is a member to which the toner images of the corresponding color components, formed by the image forming units 20, are successively transferred (first-transferred) for carrying the toner images. The intermediate transfer belt 30 is an endless belt that is placed on supporting rollers 31*a* to 31*f* and the backup roller 41. The toner images formed by the corresponding image forming units 20CL, 20CL, 20Y, 20M, 20C, and 20K are first-transferred to the intermediate transfer belt 30 while the intermediate transfer belt 30 rotates counterclockwise in a peripheral direction.

The backup roller 41 and the second transfer roller 42 that form a pair constitute a mechanism for forming a full-color image by collectively transferring (second-transferring) the toner images transferred to and superimposed on the intermediate transfer belt 30 to, for example, a sheet. The backup roller 41 and the second transfer roller 42 are disposed so as to oppose each other with the intermediate transfer belt 30 being nipped therebetween. A portion where the backup roller 41 and the second transfer roller 42 oppose each other corresponds to a second transfer section.

The backup roller 41 is rotatably set at the inner surface of the intermediate transfer belt 30. The second transfer roller 42 is rotatably set while opposing a toner-image transfer surface of the intermediate transfer belt 30. The backup roller 41 and the second transfer roller 42 are disposed so that their directions of rotational axes (that is, their directions perpendicular to the plane of FIG. 1) are parallel to each other.

When transferring the toner images on the intermediate transfer belt 30, a voltage whose polarity is the same as the toner charging polarity is applied to the backup roller 41, or a voltage whose polarity is opposite to the toner charging polarity is applied to the second transfer roller 42. This causes a transfer electric field to be formed between the backup roller 41 and the second transfer roller 42 opposing the backup roller 41, so that unfixed toner images carried by the intermediate transfer belt 30 are transferred to a sheet.

Sheets of various sizes are held in the sheet supply trays 50*a* and 50*b*. A sheet in the sheet supply tray 50*a* or 50*b* is drawn out by a pickup roller (not shown) of the sheet transporting system 60. Then, a timing is controlled by registration rollers 62 of the sheet transporting system 60, and the sheet is introduced into the second transfer section, so that the toner images are transferred to the sheet at the second transfer section. Thereafter, the sheet is transported to the fixing device 70 by a transporting belt 63 of the sheet transporting system 60. The sheet to which the toner images have been fixed by a heating roller 70*a* and a pressure roller 70*b* of the fixing device 70 is discharged to the outside of the image forming apparatus 1 by a discharge roller (not shown).

Figure 2:
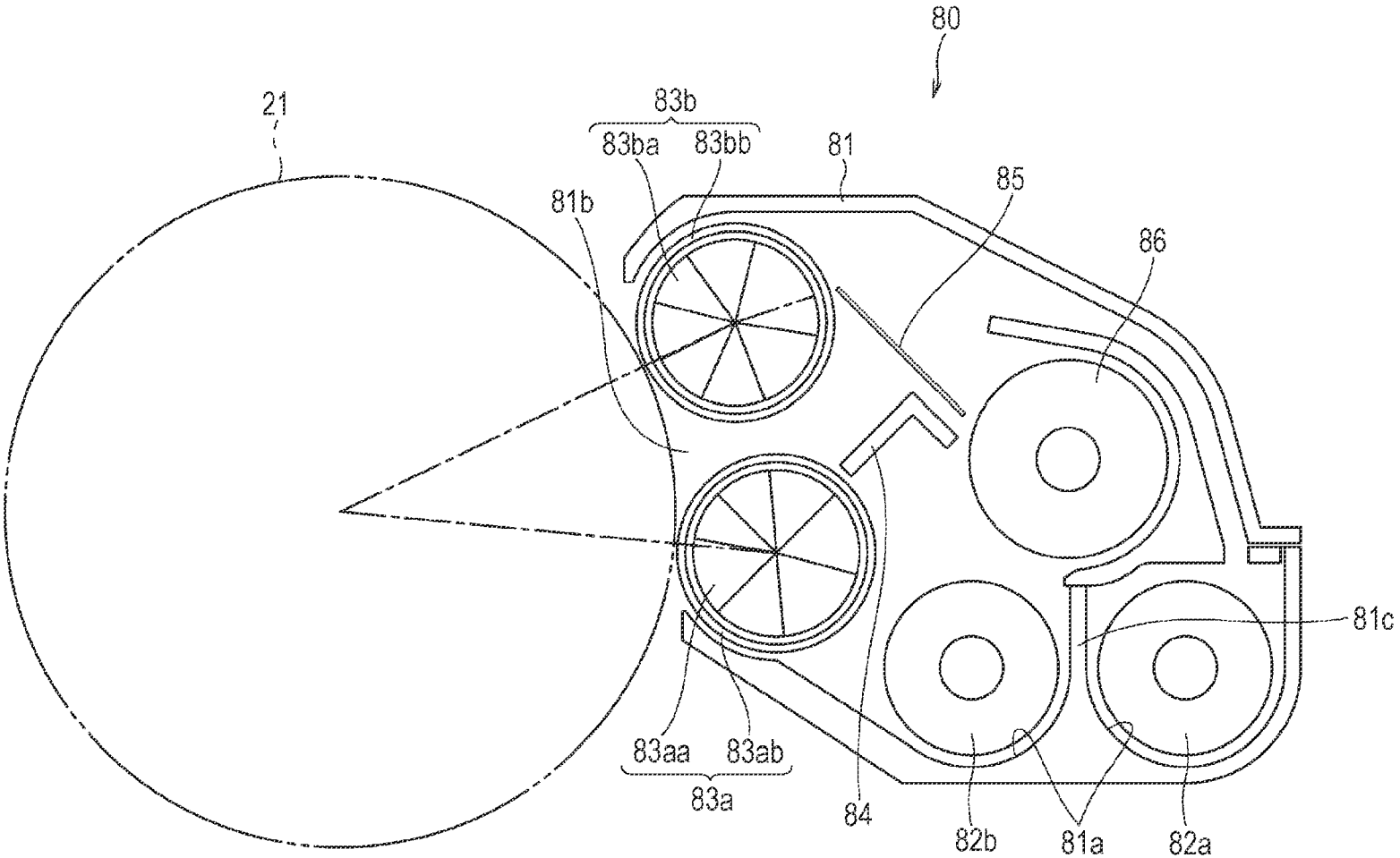
FIG. 2 is a sectional view of an exemplary developing device of the image forming apparatus shown in FIG. 1.

FIG. 2 is a sectional view of an exemplary developing device 80 of the image forming apparatus 1 shown in FIG. 1.

The developing device 80 includes a housing 81 that functions as a supporting frame. The developing device 80 includes two transporting members (exemplary developer supplying units) 82*a* and 82*b*, two developing rollers (exemplary first developing unit and exemplary second developing unit) 83*a* and 83*b*, a layer thickness regulating member 84, a transporting guide (exemplary path formation member) 85, and a rotating transporting member 86. The two transporting members 82*a* and 82*b*, the two developing rollers 83*a* and 83*b*, the layer thickness regulating member 84, the transporting guide 85, and the rotating transporting member 86 are supported in the housing 81.

The housing 81 has a developer containing portion 81*a* and an opening 81*b*. The developer containing portion 81*a* contains, for example, a two-component developer including toner and magnetic carriers. The opening 81*b* opens to a position opposing the photoconductor drum 21.

The aforementioned two transporting members 82*a* and 82*b* are disposed in the developer containing portion 81*a*. The transporting members 82*a* and 82*b* are members that transport the two-component developer to the developing rollers 83*a* and 83*b* while stirring and mixing the two-component developer. The transporting members 82*a* and 82*b* are rotatably disposed in respective right and left areas on respective sides of a partition wall 81*c* in the developer containing portion 81*a*. The transporting members 82*a* and 82*b* are disposed side by side so that their directions of rotational axes (directions perpendicular to the plane of FIG. 2) are along directions of rotational axes of the developing rollers 83*a* and 83*b*.

For example, coiled or spiral rotating members are formed at outer peripheries of rotating shafts of the respective transporting members 82*a* and 82*b*. Portions of the two-component developer in the respective areas of the developing containing portion 81*a* are transported in opposite directions in the directions of the rotational axes of the transporting members 82*a* and 82*b*. Openings (not shown) are formed in respective ends of the partition wall 81*c* in the directions of the rotational axes of the transporting members 82*a* and 82*b*. The portions of the developer in the areas that are partitioned by the partition wall 81*c* are transferred and circulated through the openings.

Of the two transporting members 82*a* and 82*b*, the transporting member 82*b* at a downstream side in the direction of transport (that is, on the left side in FIG. 2) is disposed apart from the lower developing roller 83*a* while opposing the lower developing roller 82*a*. Through a portion opposing the lower developing roller 83*a*, the two-component developer is transferred from the transporting member 82*b* to the lower developing roller 83*a*.

The developing rollers 83*a* and 83*b* are members that are used to develop an image on the surface of the photoconductor drum 21 using developer. The developing rollers 83*a* and 83*b* are disposed side by side along a vertical direction while portions of outer peripheral surfaces of the respective developing rollers 83*a* and 83*b* are exposed through the opening 81*b*. By providing double developing rollers 83*a* and 83*b*, higher speed and higher image quality is capable of being achieved while preventing an increase in temperature caused by a large number of rotations. The developing rollers 83*a* and 83*b* are disposed side by side so that their directions of rotational axes (directions perpendicular to the plane of FIG. 2) are along a direction of rotation of the photoconductor drum 21 (direction perpendicular to the plane of FIG. 2).

The outer peripheral surfaces of the respective developing rollers 83*a* and 83*b* are disposed apart from the outer peripheral surface of the photoconductor drum 21 so as to oppose the outer peripheral surface of the photoconductor drum 21. Toner is supplied to the photoconductor drum 21 from the developing rollers 83*a* and 83*b* through portions where the outer peripheral surfaces of the developing rollers 83*a* and 83*b* oppose the outer peripheral surface of the photoconductor drum 21 (that is, development nips, development poles).

The outer peripheral surface of the upper developing roller 83*b* and the outer peripheral surface of the lower developing roller 83*a* are disposed apart from each other by a gap so as to oppose each other. A portion of the developer is transferred to the upper developing roller 83*b* from the lower developing roller 83*a* through a portion where they oppose each other.

The developing roller 83*a* includes a magnet roller 83*aa* and a cylindrical sleeve 83*ab*. The developing roller 83*b* includes a magnet roller 83*ba* and a cylindrical sleeve 83*bb*. The sleeve 83*ab* is disposed around the outer periphery of the magnet roller 83*aa*. The cylindrical sleeve 83*bb* is disposed around the outer periphery of the magnet roller 83*ba*. The magnet rollers 83*aa* and 83*ba* are exemplary magnetic pole forming members. The sleeves 83*ab* and 83*bb* are exemplary rotating members. The magnet rollers 83*aa* and 83*ba* are secured and supported by the housing 81. The sleeves 83*ab* and 83*bb* are rotatably supported around the outer peripheral surfaces of the magnet rollers 83*aa* and 83*ba*, respectively.

The magnet rollers 83*aa* and 83*ba* have magnetic poles along a peripheral direction. The magnetic poles correspond to, for example, a transfer pole that causes developer to be transferred, a transport pole that causes the developer to be transported to an adjacent pole, a development pole (principal pole) that causes toner to be supplied to the surface of the photoconductor drum 21, and a separating pole that causes the developer to be separated. This causes the developer to be transferred between the two developing rollers 83*a* and 83*b*, and toner to be supplied to the photoconductor drum 21. The magnetic poles are provided in directions of rotational axes of the magnet rollers 83*aa* and 83*ba*, and magnetic fields are generated in the vicinities of even these positions in the directions of rotational axes thereof.

The sleeves 83*ab* and 83*bb* are formed of nonmagnetic materials such as aluminum, brass, stainless steel, or conductive resin. A portion of the sleeve 83*ab* of the lower developing roller 83*a* that opposes the photoconductor drum 21 rotates in a direction that is the same as the direction of rotation of the photoconductor drum 21. A portion of the sleeve 83*bb* of the upper developing roller 83*b* that opposes the photoconductor drum 21 rotates in a direction opposite to the direction of rotation of the photoconductor drum 21.

The aforementioned layer thickness regulating member 84 is a plate member that regulates the layer thickness of the two-component developer that is transported from the transporting member 82*b* to the developing rollers 83*a* and 83*b*. After the layer thickness (amount of developer) of the two-component developer that has been transferred from the transporting member 82*b* to the lower developing roller 83*a* has been regulated by the layer thickness regulating member 84, the two component developer is transported to the portion where the developing roller 83*a* opposes the photoconductor drum 21 and to the portion where the developing roller 83*b* opposes the photoconductor drum 21 (that is, the development nips, the development poles).

An end of the layer thickness regulating member 84 is disposed apart from the outer periphery of the lower developing roller 83*a* by a gap that is in accordance with a prescribed layer thickness value of the developer while opposing the outer periphery of the lower developing roller 83*a*. While the two-component developer is frictionally electrified by mutual magnetic action between the end of the layer thickness regulating member 84 and the magnet roller 83*aa* of the lower developing roller 83*a*, the layer thickness of the two-component developer is reduced and the two-component developer is carried by the surface of the sleeve 83*ab* of the lower developing roller 83*a*. The layer thickness regulating member 84 is disposed so that its longitudinal direction (that is, a direction perpendicular to the plane of FIG. 2) is along the direction of the rotational axis of the lower developing roller 83*b*.

The transporting guide 85 is a path formation member for forming a path for transporting to the rotating transporting member 86 any developer remaining on the upper developing roller 83*b* without being used in a development operation. The transporting guide 85 is disposed so as to incline at a portion between the upper developing roller 83*b* and the rotating transporting member 86, and, directly above the layer thickness regulating member 84, from the upper developing roller 83*b* towards the rotating transporting member 86. Any developer remaining on the upper developing roller 83*b* after the development is transferred to the transporting guide 85 by repulsive force at a separation area of the magnet roller 83*b* and rotational centrifugal force at the developing roller 83*b*, slides along an inclined surface as it is, and is transported to the rotating transporting member 86. The transporting guide 85 is primarily formed of, for example, stainless steel or aluminum, and is disposed so that its longitudinal direction (that is, a direction perpendicular to the plane of FIG. 2) is along the direction of the rotational axis of the developing roller 83*b* and a direction of a rotational axis of the rotating transporting member 86.

The above-described rotating transporting member 86 is a member for returning the developer remaining on the upper developing roller 83*b* into the developer containing portion 81*a*. The rotating transporting member 86 is set directly above a portion between the transporting members 82*a* and 82*b* and adjacent to the layer thickness regulating member 84 (that is, to the immediate right of the layer thickness regulating member 84 in FIG. 2) while being rotatable clockwise. The outer periphery of a rotating shaft of the rotating transporting member 86 is provided with four rotating blades (not shown) that are L-shaped in cross section. The rotating transporting member 86 is disposed so that the direction of the rotational axis thereof (that is, a direction perpendicular to the plane of FIG. 2) is along the directions of the rotational axes of the developing rollers 83*a* and 83*b* and the transporting members 82*a* and 82*b*.

It is possible to achieve higher speed and higher image quality of the developing device 80 by providing multiple developing rollers as described above. However, the developer remaining on the upper developing roller 83*b* without being used in a development operation causes low toner density. Therefore, the developer may be used again in a development operation by adhering to the upper developing roller 83*b* without being transported to the rotating transporting member 86 and the transporting members 82*a* and 82*b*, or may be used again in a development operation as a result of dropping to the lower developing roller 83*b*. Consequently, image failure may result.

To address these problems, the developer remaining on the upper developing roller 83*b* may be reliably transported to the rotating transporting member 86 and the transporting members 82*a* and 82*b* by bringing the end of the transporting guide 85 into contact with the surface of the upper developing roller 83*b*. However, in such a case, in addition to driving force of the sleeve 83*bb* being increased and the size of the developing device 80 being increased, the life of the developing device 80 is reduced due to wear of the sleeve 83*bb*.

To address these problems, a gap between the surface of the upper developing roller 83*b* and the end of the transporting guide 85 may be set 10 to 30 times the diameter of a carrier particle. Since the diameter of the carrier particle is on the order of 30 μm, the size of the gap between the surface of the upper developing roller 83*b* and the transporting member 85 is on the order of from 0.3 to 0.9 mm. In this case, the allowance of the gap is only on the order of 0.6 mm. This may be achieved in a test manufacture. However, there are differences among parts that are mass-produced. Therefore, it is difficult to set the allowance of the gap within this range because the allowance of the gap is too small. As a result, image failure caused by improper separation of the developer occurs.

To address these problems, the exemplary embodiment uses the following structure. The structure is explained with reference to FIGS. 3 to 11. In the following description, the upstream side of the upper developing roller 83*b* in the direction of rotation of the sleeve 83*bb* is simply referred to as "upstream", and the downstream side of the upper developing roller 83*b* in the direction of rotation of the sleeve 83*bb* is simply referred to as "downstream".

Figure 3:
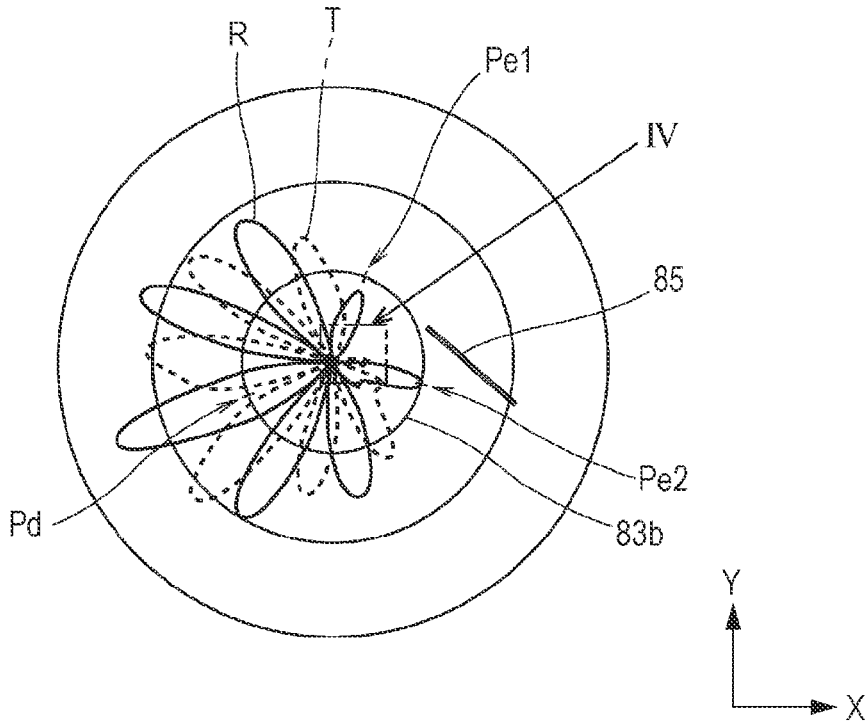
FIG. 3 illustrates magnetic lines of force at an upper developing roller of the developing device shown in FIG. 2.

First, FIG. 3 illustrates magnetic lines of force of the upper developing roller 83*b*. A solid line indicates a vertical component R of a magnetic force, and a broken line indicates a horizontal component T of the magnetic force. A first separating pole Pe1 defines a starting point of the separation area where the developer is separated. A second separating pole Pe2 that is disposed downstream of the first separating pole Pe1 defines an end point of the separation area. The first separating pole Pe1 and the second separating pole Pe2 are both set as, for example, S poles. A development pole Pd is a principal pole that causes toner to be supplied to the surface of the photoconductor drum 21, and is set as, for example, an N pole.

Figure 4:
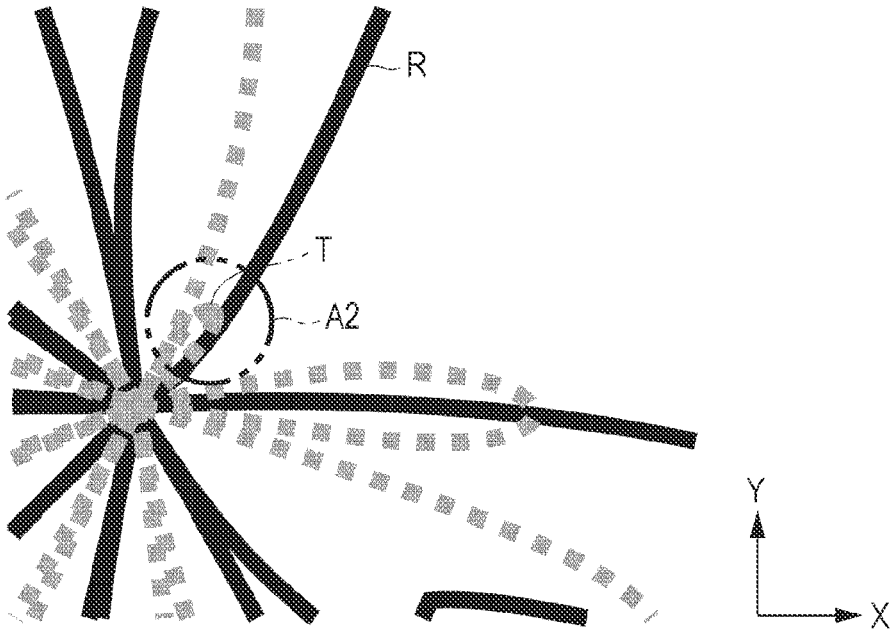
FIG. 4 is an enlarged view of an area IV in a separation area of the upper developing roller shown in FIG. 3.

FIG. 4 is an enlarged view of an area IV in the separation area of the upper developing roller 83*b* shown in FIG. 3. In the exemplary embodiment, as shown by an area A2 in FIG. 4, the vertical component R is disposed downstream of the horizontal component T at a side of the first separating pole Pe1 of the separation area of the upper developing roller 83*b*. This will be described in further detail.

Figure 5:
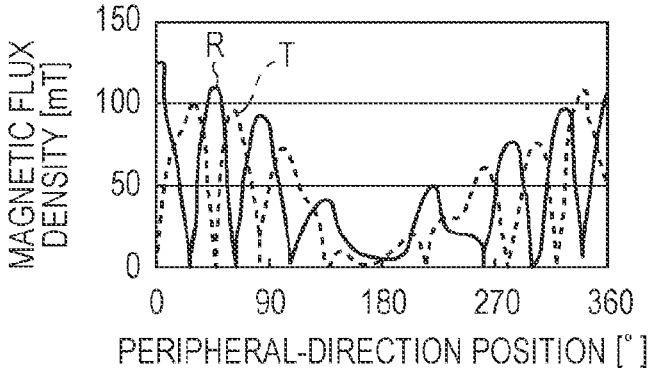
FIG. 5 is a graph in which a state of a vertical component and a state of a horizontal component of a magnetic force at the upper developing roller shown in FIG. 3 are developed with a development pole being defined as zero degrees.
Figure 6:
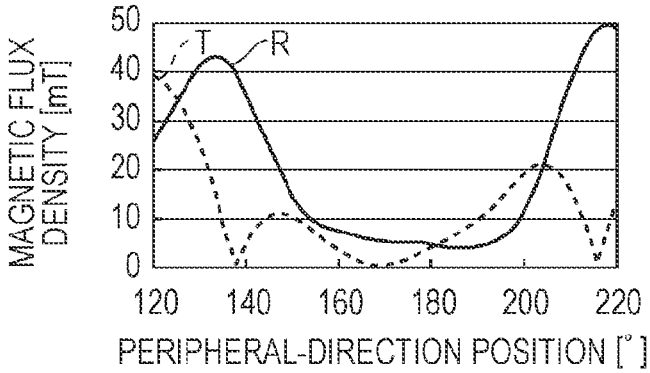
FIG. 6 is a graph showing an enlarged portion including the separation area shown in FIG. 5.
Figure 7:
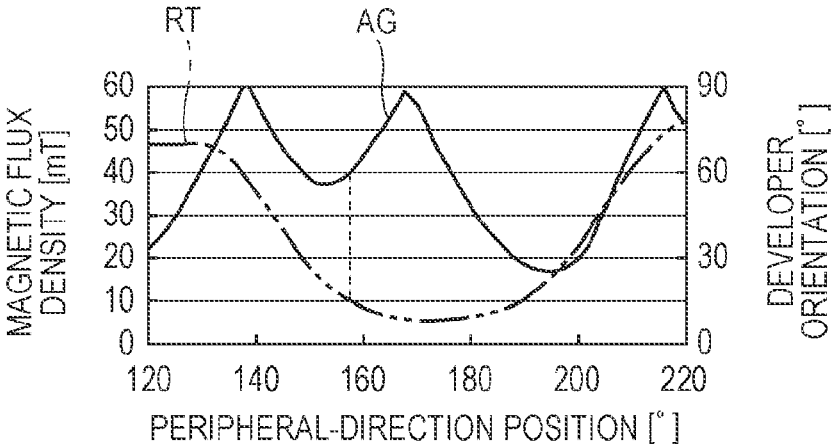
FIG. 7 is a graph showing a state of a resultant component of the vertical component and the horizontal component of the magnetic force at the upper developing roller shown in FIG. 3, and a state of a developer orientation (chain standing angle)

FIG. 5 is a graph in which a state of the vertical component R and a state of the horizontal component T of the magnetic force at the upper developing roller 83*b* shown in FIG. 3 are developed with the development pole Pd being defined as zero degrees. FIG. 6 is a graph showing an enlarged portion including the separation area shown in FIG. 5. FIG. 7 is a graph showing states of a resultant component (alternate long and two short dash lines) RT of the vertical component R and the horizontal component T of the magnetic force at the upper developing roller 83*b* shown in FIG. 3, and a developer orientation (chain standing angle) AG.

Although it is not possible to generalize because it depends on, for example, the diameter of a magnetic carrier in developer and the rotational speed of the sleeve 83*bb*, since the magnetic flux density where the force by which the magnet roller 83*b* of the upper developing roller 83*b* actually pulls the developer and centrifugal force at the sleeve 83*bb* are in equilibrium is on the order of 15 mT, if the magnetic flux density becomes less than or equal to 10 mT (an exemplary reference separation value), the centrifugal force becomes stronger than the pulling force, so that the developer is separated.

In this case, in the exemplary embodiment, as shown in FIGS. 5 and 6, at the side of the first separating pole Pe1 of the separation area of the upper developing roller 83*b* (peripheral positions at from about 150 to 160 degrees), the position where the magnetic flux density of the vertical component R of the magnetic force becomes less than or equal to 10 mT is situated downstream of the position where the magnetic flux density of the horizontal component T of the magnetic force becomes less than or equal to 10 mT.

Explaining this in more detail, in an area where the magnetic flux density of a resultant component of the vertical component and the horizontal component of the magnetic force becomes less than or equal to 10 mT (peripheral positions at from about 150 to 160 degrees) in the separation area of the upper developing roller 83*b*, the vertical component R of the magnetic force is greater than the horizontal component T of the magnetic force. In this case, as shown in FIG. 7, it is seen that from the position where the resultant component RT becomes less than or equal to 10 mT, the developer orientation becomes greater than or equal to 60 degrees.

By such a magnetic structure, the developer remaining on the upper developing roller 83*b* without being used in a development operation properly stand in the form of a chain. Therefore, the developer in this case is separated from an upper stream side than when the developer is laid. Consequently, the separability of the developer is increased. Such a magnetic structure is formed on the basis of, for example, how a magnet having the first separating pole Pe1 of the magnet roller 83*ba* is cut or disposed.

Figure 8:
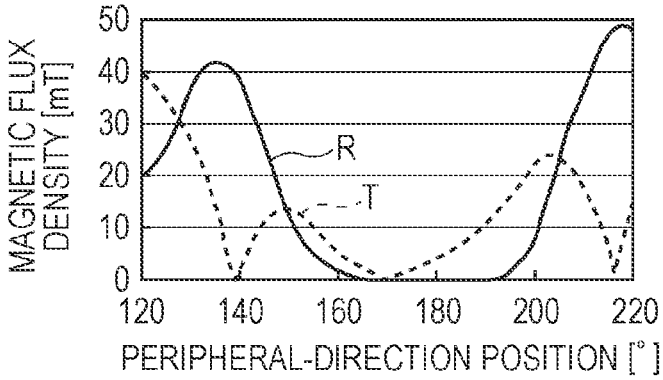
FIG. 8 is a graph for comparing the state of the vertical component and the state of the horizontal component of the magnetic force at the upper developing roller when the separation performance with respect to the developer is poor.
Figure 9:
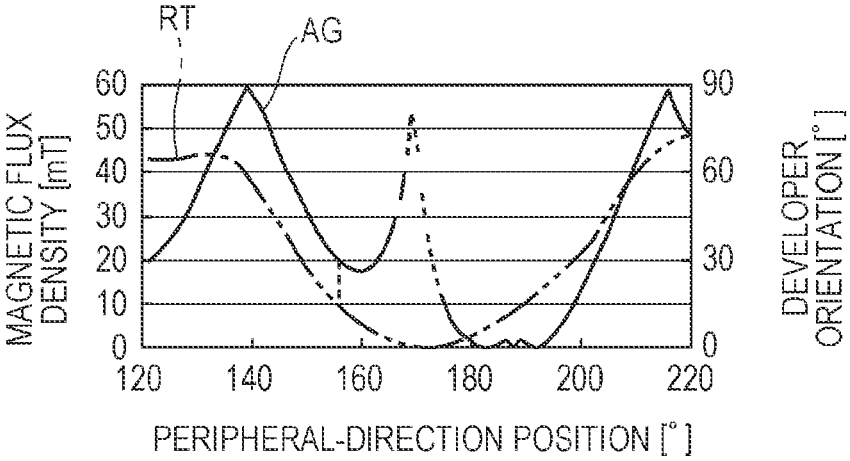
FIG. 9 is a graph for comparing the states of a resultant component of the vertical component and the horizontal component of the magnetic force at the upper roller and the developer orientation (chain standing angle) when the separation performance with respect to the developer is poor.

FIGS. 8 and 9 are graphs for comparison with a case in which such a magnetic structure is not used. FIG. 8 corresponds to FIG. 6. FIG. 9 corresponds to FIG. 7. In FIG. 8, at the side of the first separating pole Pe1 of the separation area of the upper developing roller 83*b* (peripheral positions at from about 150 to 160 degrees), the position where the magnetic flux density of the vertical component R of the magnetic force becomes less than or equal to 10 mT is situated upstream (this is opposite to that in the exemplary embodiment) of the position where the magnetic flux density of the horizontal component T of the magnetic force becomes less than or equal to 10 mT. In this case, as shown in FIG. 9, it is seen that from the position where the resultant component RT becomes less than or equal to 10 mT, the developer orientation becomes less than or equal to 20 degrees, so that the developer is separated while being in a laid state.

Figure 10:
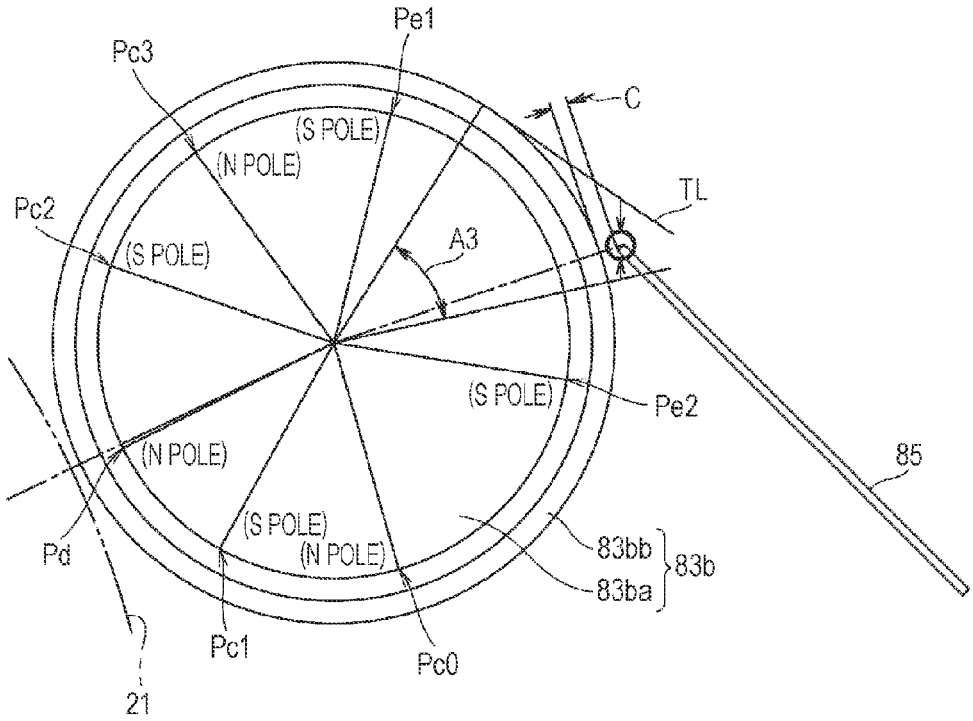
FIG. 10 is an enlarged view schematically showing the upper developing roller of the developing device shown in FIG. 2.

Next, the relationship between the position of the upper developing roller 83*b* and the position of the transporting guide 85 will be described with reference to FIG. 10. FIG. 10 is an enlarged view schematically showing the upper developing roller 83*b*. Pc0 denotes the transfer pole, which is an N pole. Pc1 and Pc2 both denote the transfer poles, which are S poles. Pc3 denotes the transport pole, which is an N pole.

In the exemplary embodiment, an end of the transporting guide 85 is disposed apart from the surface of the upper developing roller 83*b* by a gap C. In addition, this end is disposed below a tangent line TL drawn from a position where the magnetic flux density becomes less than or equal to the reference separation value (such as 10 mT) at the side of the first separating pole Pe1 of the separation area (that is, a starting position of an area A3 where it is possible to consider that the magnetic flux density is substantially zero). Further, this end is disposed above a position where the magnetic flux density at the second separating pole Pe2 rises (that is, an end position of the area A3 where it is possible to consider that the magnetic flux density is substantially zero).

By this, the developer that has been separated from the developing roller 83*b* is transferred onto the transporting guide 85 without being influenced by the second separating pole Pe2. Therefore, the separability of the developer after the development is increased.

Figure 11:
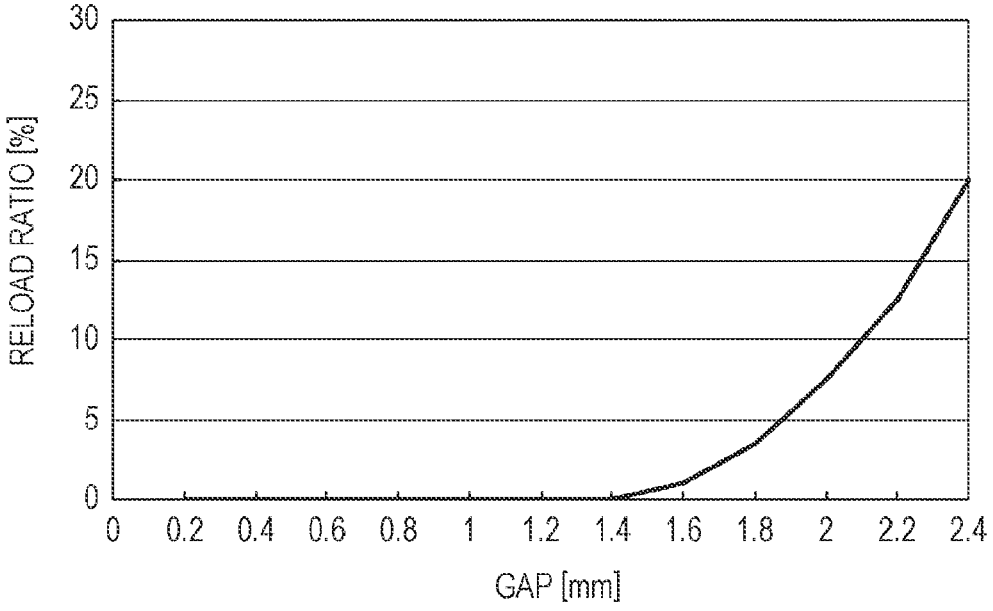
FIG. 11 is a graph showing the relationship between a developer reload ratio and a gap from the surface of the upper developing roller to an end of a transporting guide of the developing device shown in FIG. 2.

FIG. 11 is a graph showing the relationship between a developer reload ratio and the gap C from the surface of the upper developing roller 83*b* to the end of the transporting guide 85 of the developing device 80 according to the exemplary embodiment. As shown in FIG. 11, by setting the above-described magnetic structure and by setting the position of the end of the transporting guide 85 in the aforementioned way, it is possible increase the allowance of the gap C between the surface of the upper developing roller 83*b* and the end of the transporting guide 85 from 0.24 mm (which is 10 times the diameter of a magnetic carrier particle of the developer) to 1.4 mm (which is 60 times the diameter of a magnetic carrier particle of the developer). When the allowance of the gap C is greater than or equal to 1 mm, even if there are differences among parts that are mass-produced, the gap C between the surface of the developing roller 83*b* and the end of the transporting guide 85 is set within the allowable range. Therefore, the separation performance with respect to the developer is enhanced. Consequently, when this developing device 80 is used in the image forming apparatus 1, image failure in the image forming apparatus 1 caused by improper separation of the developer remaining on the upper developing roller 83*b* without being used in the development operation is suppressed or prevented.

Such a developing device 80 operates, for example, in the following way.

A two-component developer that is contained in the developer containing portion 81*a* of the developing device 80 is stirred and mixed by the transporting members 82*a* and 82*b*, and is supplied to the surface of the lower developing roller 83*a*. The two-component developer that has been attracted to the surface of the sleeve 83*ab* of the lower developing roller 83*a* by the magnetic poles of the magnet roller 83*aa* of the lower developing roller 83*a* is transported to the layer thickness regulating member 84 by the rotation of the sleeve 83*ab*. While the two-component developer is frictionally electrified by mutual magnetic action between the layer thickness regulating member 84 and the magnet roller 83*aa* of the lower developing roller 83*a*, the layer thickness of the two-component developer (the amount of developer) is regulated and the two-component developer is carried by the surface of the sleeve 83*ab*.

The layer thickness of the developer that has passed the layer thickness regulating member 84 is reduced, and the developer whose layer thickness has been reduced is substantially divided in two portions at a position opposing the upper developing roller 83*b*. By the action of the magnetic poles, one of the portions of the developer is transferred to the upper developing roller 83*b*, and the other portion of the developer is carried and transported onto the sleeve 83*ab* of the lower developing roller 83*a*.

The portion of the developer carried by the sleeve 83*ab* of the lower developing roller 83*a* is transported to the portion of the lower developing roller 83*a* opposing the photoconductor drum 21 (that is, the development nip, the development pole). A development bias voltage applied between the lower developing roller 83*a* and the photoconductor drum 21 causes toner of the developer to be transferred to an electrostatic latent image on the photoconductor drum 21.

The portion of the developer carried by the sleeve 83*bb* of the upper developing roller 83*b* is transported to the portion of the upper developing roller 83*b* opposing the photoconductor drum 21 (that is, the development nip, the development pole) by the rotation of the sleeve 83*bb*. A development bias voltage applied between the upper developing roller 83*b* and the photoconductor drum 21 causes toner of the developer to be transferred to the electrostatic latent image on the photoconductor drum 21.

Any developer remaining on the sleeve 83*bb* of the upper developing roller 83*b* without being used in a development operation is separated therefrom and is transferred to the transporting guide 85. The developer is separated by the aforementioned magnetic action at the separation area between the first separating pole Pe1 and the second separating pole Pe2 of the magnet roller 83*ba* of the upper developing roller 83*b* and by the action of the centrifugal force at the sleeve 83*bb* of the upper developing roller 83*b*.

In separating the developer, the developer is properly moved towards the end of the transporting guide 85 while the developer stands in the form of a chain at an angle of at least 45 degrees. Therefore, the separation performance with respect to the developer remaining on the upper developing roller 83*b* is enhanced. Consequently, image failure in the image forming apparatus 1 caused by improper separation of the developer remaining on the upper developing roller 83*b* without being used in the development operation is suppressed or prevented.

The developer that has been transferred to the transporting guide 85 slides along the inclined surface of the transporting guide 85, is transported to the rotating transporting member 86, and is transported to the developer containing portion 81*a*. Thereafter, the same operations as those described above are repeated.

Although the invention carried out by the inventors is described in detail on the basis of an exemplary embodiment, the exemplary embodiment disclosed in the specification is an exemplification on all points, and should not to be thought of as limiting the disclosed technology. That is, the technical scope of the present invention is not to be construed in a limited sense on the basis of the explanation in the exemplary embodiment. The technical scope of the present invention should be strictly construed in accordance with the scope of the claims. Accordingly, technologies that are equivalent to the technology that is set forth in the scope of the claims and all modifications that do not depart from the gist of the scope of the claims are included.

Although, in the exemplary embodiment, the invention is applied to an intermediate-transfer image forming apparatus that transfers a toner image transferred to the intermediate transfer belt to a sheet, the invention is not limited thereto. The invention may be applied to a direct-transfer image forming apparatus that directly transfers a toner image on a photoconductor drum to a sheet (exemplary transfer medium).

Although, in the exemplary embodiment, the number of developing rollers disposed in a developing device is two, the present invention is not limited thereto. The number of developing rollers may be one or three or more.

Although, in the exemplary embodiment, a sheet is used as a recording medium, the present invention is not limited thereto. For example, a film, a postcard, or various other materials on which images are formed may be used.

Although, in the foregoing description, the present invention is applied to a color printer, the present invention may be applied to, for example, a color copying machine, a facsimile, an image forming apparatus having the functions of both the color copying machine and the facsimile, and other types of image forming apparatuses.

What is claimed is:

1. A developing device comprising:

a first developing unit that performs development to form a toner image using developer;

a second developing unit that is disposed above the first developing unit and that performs development to form the toner image using the developer;

a rotating member that is rotatably provided at an outer periphery of the second developing unit;

a magnetic pole forming member that is provided at an inner side of the rotating member, the magnetic pole forming member having separating poles that include a first separating pole and a second separating pole, the separating poles defining a separation area where the developer is separated;

the first separating pole that defines a starting point of the separation area;

the second separating pole that is disposed downstream of the first separating pole in a direction of rotation of the rotating member, the second separating pole defining an end point of the separation area;

a developer supplying unit that supplies the developer to the first developing unit and the second developing unit; and a path formation member that is disposed with an end portion thereof being out of contact with the outer periphery of the second developing unit, the path formation member forming a path for returning residual developer remaining on the second developing unit without being used in the development to the developer supplying unit, wherein a magnetic structure is provided, in which, when a value of a magnetic flux density at which the developer is separated is a reference separation value, at a side of the first separating pole at the separation area of the second developing unit, a position where a magnetic flux density of a vertical component of a magnetic force becomes less than or equal to the reference separation value is disposed downstream in the direction of rotation of the rotating member of a position where a magnetic flux density of a horizontal component of the magnetic force becomes less than or equal to the reference separation value.

2. The developing device according to claim 1, wherein the magnetic structure is such that, at an area where a magnetic flux density of a resultant component of the vertical component and the horizontal component of the magnetic force becomes less than or equal to the reference separation value in the separation area of the second developing unit, the magnetic flux density of the vertical component of the magnetic force becomes greater than the magnetic flux density of the horizontal component of the magnetic force.

3. The developing device according to claim 1, wherein the end portion of the path formation member is disposed below a tangent line drawn from a position where a magnetic flux density of a magnetic force becomes less than or equal to the reference separation value at the side of the first separating pole at the separation area of the second developing unit, and is disposed above a position where a magnetic flux density at the second separating pole rises.

4. The developing device according to claim 2, wherein the end portion of the path formation member is disposed below a tangent line drawn from a position where a magnetic flux density of a magnetic force becomes less than or equal to the reference separation value at the side of the first separating pole at the separation area of the second developing unit, and is disposed above a position where a magnetic flux density at the second separating pole rises.

5. An image forming apparatus comprising:

an image carrying member on which an electrostatic latent image is formed;

the developing device according to claim 1 that is provided so as to oppose the image carrying member, the developing device performing the development to form the toner image by causing toner to adhere to the electrostatic latent image on the image carrying member; and a transferring unit that is provided so as to oppose the image carrying member, the transferring unit transferring the toner image formed by the development on the image carrying member to a transfer medium.

* * * * *